US007488525B2

(12) United States Patent
Bird et al.

(10) Patent No.: US 7,488,525 B2
(45) Date of Patent: Feb. 10, 2009

(54) IMPACT-ATTENUATING, FIRM, STABLE, AND SLIP-RESISTANT SURFACE SYSTEM

(75) Inventors: Elouise R. Bird, Sandy, UT (US); John C. Bird, Sandy, UT (US)

(73) Assignee: Sof' Solutions, Inc., Bluffdale, UT (US)

( * ) Notice: Subject to any disclaimer, the term of this patent is extended or adjusted under 35 U.S.C. 154(b) by 285 days.

(21) Appl. No.: 11/279,069

(22) Filed: Apr. 7, 2006

(65) Prior Publication Data

US 2007/0087154 A1 Apr. 19, 2007

Related U.S. Application Data

(60) Provisional application No. 60/596,713, filed on Oct. 14, 2005.

(51) Int. Cl.
*E01C 13/04* (2006.01)

(52) U.S. Cl. ..... 428/44; 472/92

(58) Field of Classification Search ..... 428/44, 428/58, 60; 52/177, 180; 404/32; 472/92
See application file for complete search history.

(56) References Cited

U.S. PATENT DOCUMENTS 2,999,431 A * 9/1961 Mitchell ..... 472/92
3,206,785 A * 9/1965 Heil ..... 15/215
5,298,217 A 3/1994 Mitchell
5,326,614 A 7/1994 Doose
5,364,204 A * 11/1994 MacLeod ..... 404/35
5,428,935 A 7/1995 Mitchell
5,456,966 A * 10/1995 Austin ..... 428/120
5,714,263 A 2/1998 Jakubisin et al.
5,833,386 A * 11/1998 Rosan et al. ..... 404/36
5,865,004 A 2/1999 Mitchell
5,910,514 A 6/1999 Greenberg et al.
6,287,049 B1 9/2001 Keinholz
6,572,952 B1 6/2003 Kanter
6,623,840 B2 9/2003 Hainbach
6,777,062 B2 8/2004 Skaja
6,796,096 B1 9/2004 Heath
7,211,314 B2 * 5/2007 Nevison ..... 428/143
2007/0042828 A1 * 2/2007 Krushke et al. ..... 472/92

* cited by examiner

*Primary Examiner*—Alexander Thomas
(74) *Attorney, Agent, or Firm*—Dax D. Anderson; Kirton & McConkie

(57) ABSTRACT

A system and method of providing a wheelchair accessible path through a variety of impact attenuating surfaces including loose fill materials. The combination of a tarmac and loose fill material provides an ASTM compliant impact attenuating surface for playgrounds and other activities. The modular tarmac 15 is also used in wet conditions to improve the traction and impact attenuation over traditional materials used in water parks, and also for reducing wear to park patrons' feet.

13 Claims, 8 Drawing Sheets

IMPACT-ATTENUATING, FIRM, STABLE, AND SLIP-RESISTANT SURFACE SYSTEM

DESCRIPTION

This application claims priority to U.S. Provisional Patent Application 60/596,713, filed Oct. 14, 2005.

BACKGROUND

Research has shown that, on average, more than 200,000 children are treated in U.S. hospital emergency rooms for playground-equipment-related injuries, many of which result from falls. To minimize the risks associated with playgrounds, a number of guidelines are established which require surfaces under the playgrounds to attenuate the impact of a fall.

While the primary function of a surface is often safety, the Americans' with Disabilities Act ("ADA") also requires playgrounds be wheelchair accessible. Thus a surface must be soft enough to sufficiently attenuate the impact of a fall, while at the same time be firm, stable and slip resistant enough to comply with the ADA. Oftentimes, these two apparently conflicting requirements are reconciled by placing a solid access path to the playground structure. While such a path complies with ADA requirements, it also poses the risk that anyone falling onto the surface could result in serious injury or even death.

A combination of guidelines promulgated from both government and independent bodies tackle the tricky issue of providing surfaces at play grounds that are soft enough to prevent most fall injuries but that are also firm and stable enough for wheelchair maneuvering. For example, the guidelines, based on American Society for Testing and Materials (ASTM) standards, state that wheelchair access, surfaces are required to be "firm, stable and slip resistant" as specified in Americans with Disabilities Act Accessibility Guidelines (ADAAG). Another example is the amount of force required to rotate the caster wheels of a wheel chair as set for in ASTM standard F-1951, which is based on a measurement of the physical effort to maneuver a wheelchair across a surface. Accessible surfaces within the use zone (the ground level area beneath and immediately adjacent to a play structure) are also required to be "impact attenuating" in compliance with ASTM F-1292 requirements for drop testing.

Materials currently used as impact-absorbing surfaces under playgrounds include sand and gravel, shredded tires, poured rubber to name a few. Sand and gravel have been traditionally used because of their impact attenuation properties, wide availability and low cost. However, such a surface is not wheelchair accessible. In addition, sand and gravel tends to lump and harden when wet or frozen. In addition, the critical fall height for sand and gravel is merely nine feet, which is reduced to five feet when the sand or gravel is compressed. Furthermore, such a surface can cause abrasions when a playground patron falls, can cause a patron to trip when running, is tracked indoors and can cause scratches on floors, can be thrown, can be blown away with wind, as well as be an attraction for cats and other animals. Thus, sand and gravel are not ideal materials to use for playground purposes.

Alternatively, shredded tires are used, however, these pose additional problems of becoming very hot when in direct sunlight, being flammable, and containing steel belts that were part of the original tire. Additionally, shredded tire installations, when properly installed to attenuate falls, do not meet the requirements for accessibility as defined in ASTM F-1959.

Similarly, poured rubber is used because it is wheelchair accessible, however, it is expensive to purchase and install. In addition, as the rubber wears out under high traffic areas such as swings, the rubber cannot be replaced without significant additional expense. Furthermore, several obstacles arise during installation such as bonding the rubber to the cement base or ground arid requiring completely level ground when the rubber is poured. Poured rubber is also prone to cracking and mechanical failure if exposed to ultraviolet light, extreme temperatures or water. There is evidence that, when exposed to environmental factors over time, a poured surface may deteriorate to the point where it will fail ASTM F-1292 testing.

Matching the appropriate surface and application can also pose problems. For example, a pool and its surround deck are often made of cement which can get very slick when wet, and a fall thereon may cause a serious injury. Similarly an injury may result from a person diving into and hitting the bottom of a cement pool. Alternatively a cement surface can be so abrasive so as to cause blisters or cuts on swimmers' feet.

Given the known hazards and limitations of existing surfaces, an impact-attenuating surface, which is also firm, stable, and slip-resistant in accordance with the ADA, would be beneficial.

SUMMARY

Certain exemplary embodiments shown herein comprise an impact attenuating tarmac that may be used in conjunction with an impact attenuating base such as loose fill or poured rubber. Alternatively, the tarmac may be used in wet environments to improve surface traction, reduce blisters and scrapes on patrons' feet and also to attenuate the impact of a patron falling. The tarmac further provides a firm, stable and slip resistant surface in accordance with the ADA.

DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein.

The Head Injury Criterion ("HIC") is a measure of the severity of an impact and takes into account its duration as well as its intensity. The criterion is based on the results of research into the effects of impacts on the human head. HIC is defined by the following integral formula $$HIC = \left[ (t_2 - t_1) \left\{ \frac{1}{(t_2 - t_1)} \int_{t_1}^{t_2} a \cdot dt \right\}^{2.5} \right]_{\max}$$

Where "t" is defined as time and "a" is defined as deceleration at time t.

G-max is the maximum deceleration experienced by the head (or headform) during an impact. It is a measure of the peak forces that a likely to be inflicted on the head as a result of the impact. It is measured in standard units of G, acceleration due to gravity −9.8 m/s/s.

Critical fall height is the minimum free fall height resulting from all test drops of an instrumented head onto a surface for which an HIC less than 1000 or a G-max value less than 200 is obtained. Thus, for example, if the instrument is dropped from a fall height of X feet onto a non-impact attenuating surface the force of the impact may be HIC of 1500 and a G-max of 210. Such force may lead to injury in a person. In contrast if the same instrument were then dropped from the same fall height onto an impact attenuating surface the HIC might be 500 and the G-max might be 100, and accordingly the probability of an injury resulting is much less.

Figure 1:
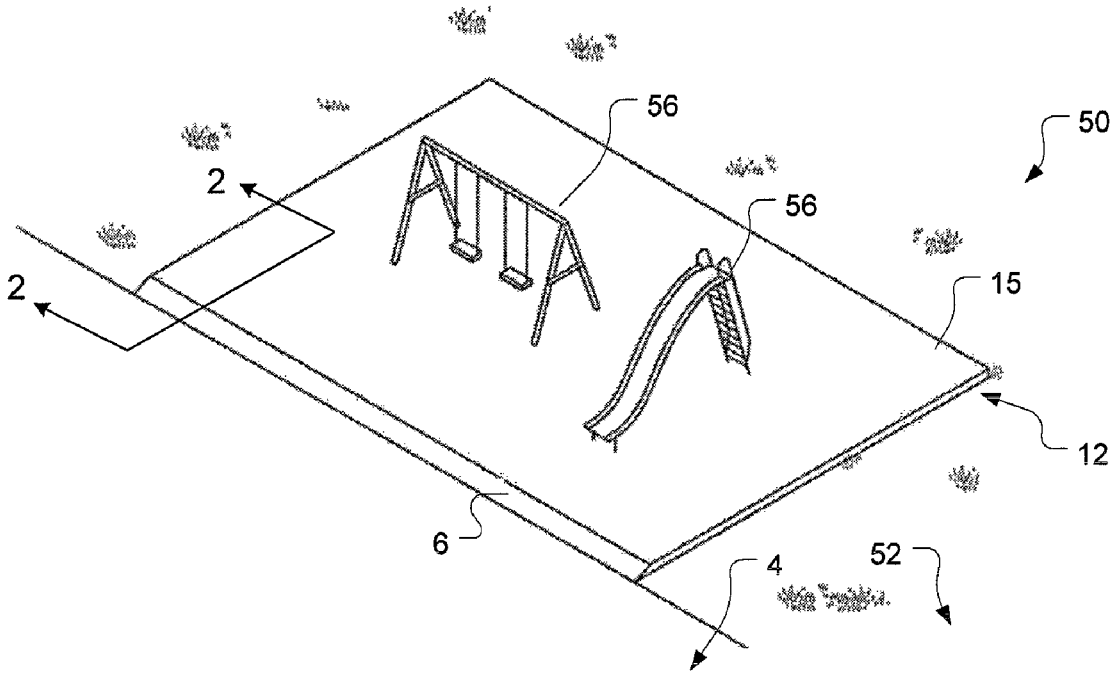
FIG. 1 illustrates an exemplary play ground area for children according to some embodiments of the invention.

FIG. 1 illustrates an exemplary play ground area 50 for children such as may typically be found in school yards, parks, etc. The play ground area 50 includes play ground equipment 56 (e.g., one or more swing sets, slides, climbing bars, etc.) and an impact attenuation system 12. As will be seen, impact attenuation system 12 is designed to absorb energy from an impact and thus protect children from falls from playground equipment 56, and impact attenuation system 12 may also be configured to have a sufficiently firm surface to allowed rolling equipment (e.g., a wheel chair, a baby stroller, etc.) to be pushed across the tarmac 15 of impact attenuation system 12. The exemplary play ground area 50 shown in FIG. 1 is surrounded on three sides by a lawn area 52 and on one side by an asphalt or concrete area 4. A small ramp 6 is provided between asphalt area 4 and tarmac 15.

Figure 2:
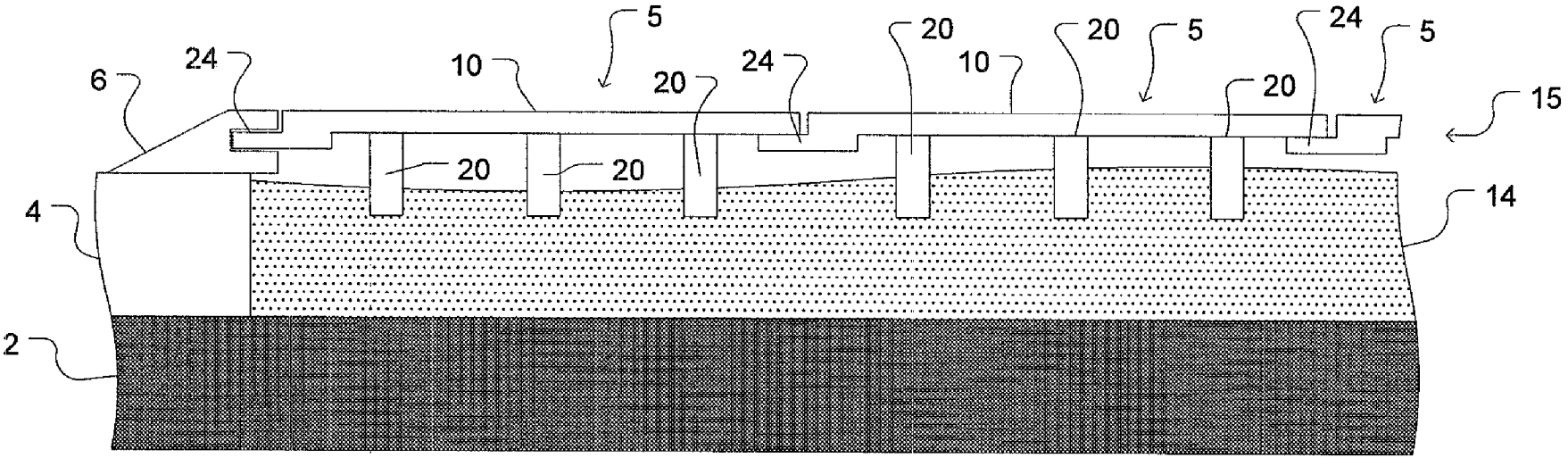
FIG. 2 illustrates a partial side, cross-sectional view of an impact attenuation system of the play ground area of FIG. 2.

FIG. 2 shows a partial side, cross sectional view of an exemplary configuration of impact attenuating system (see FIG. 1) according to some embodiments of the invention. As shown in FIG. 2, the impact attenuating system 12 includes fill material 14, which is disposed on the ground 2 under play ground area 50. Tarmac 15 is formed of a plurality of interlocking mats 5, which cover fill material 14. The fill material 14 may be loose or a solid-fill material such as those commonly used in the art for impact attenuation. Examples of such materials include wood chips, sand, gravel, shredded tires, poured rubber or other similar materials suitable for absorbing an impact from a child's fall. As shown in FIG. 2, each mat 5 includes a surface structure 10 and legs 20, which may rest on an upper surface of fill material 14 or, as shown in FIG. 2, may extend at least partially into fill material 14. Each mat 5 also includes a linking tab 24 that interlocks a mat 5 with an adjacent mat by sliding into slot 25 (see FIG. 4). A plurality of mats 5 can thus be interlocked to form tarmac 15 in just about any desired shape and size.

FIG. 2 also shows part of a asphalt area 4 and ramp 6, which may be formed of a plurality of sloped mats that interlock with a linking tab 24 of a mat 5 as shown. Ramp 6 provides a sloped ramp structure from the asphalt area 4 to the tarmac 15.

Although fill material 14 shown in FIG. 2 is loose, allowing legs 20 to sink into the fill material 14, a landscape fabric (not shown) may be placed between fill material 14 and legs 20, preventing legs 20 from sinking into fill material 14. Such a landscape fabric (not shown) may additionally protect the fill material 14 from, for example, ultra violet light from the sun.

Because the exemplary tarmac 15 shown in FIG. 2 is modular, that is, formed of a plurality of interlocking mats 5, individual mats 5 may be replaced as specific areas wear out. This may occur under swings or other high traffic areas or through damage and vandalism. Similarly as particular mats 5 of the tarmac 15 are adversely affected by weather or ultraviolet degradation from exposure to sunlight, or have a mechanical failure such mats 5 can be replaced. The upper surface of the tarmac 15 may comprise an undulating surface to improve traction, and to provide flex, which will attenuate an impact. The undulating upper surface of the tarmac 15 may optionally comprise a plurality of small flexible arches, the elasticity of the ach being determined by the materials from which the tarmac 15 is made.

Mats 5 can be made from a number of different materials, including but not limited to, synthetic polymers such as PVC, as well as a variety of other polymers commonly known in the art. Furthermore, mats 5 can be formed in molds, using extrusion techniques, etc. An edging (e.g., comprising one or more ramps 6) can also be used to couple the tarmac 15 to another surface such as a cement or asphalt surface, or to reduce the amount of energy needed to get a wheelchair onto the tarmac 15 surface. The edge thus may be an extension from the tarmac 15 surface to another surface, or it may be tapered to provide a ramp from another surface up to the tarmac 15 surface (e.g., like ramp 6 shown in FIG. 2).

Extending from the bottom of each mat 5 are legs 20. As mention above, the legs 20 may sit on top of the fill material 10, or the fill material may work its way to fill the interstitial spaces between the legs 20. Legs 20 may be a variety of different lengths. If the legs 20 have different lengths, each leg 20 will make contact with the fill material 14 at different times and thus increase energy impact dissipation and attenuation of an impact of a fall. Furthermore, the legs 20 further improve the impact-attenuation properties of the energy absorption system by concentrating force onto certain areas, and allowing the tarmac 15 surface to flex. The mats may also be used to reduce erosion in high traffic areas, or to promote growth of vegetation in high traffic areas.

Mats 5 may be tethered to ground 2 to prevent the tarmac 15 from sliding off the fill material 14. In addition, the tethers (not shown) may help anchor the fill material 10 in a stationary position. Any tethering structure suitable for anchoring mats 5 to ground 2 may be used. For example, rigid steel spikes may be driven through mats 5 and into ground 2. As another example, mats 5 may be tied using string, wire or rope to spikes that are driven into ground 2 below tarmac 15.

Figure 3:
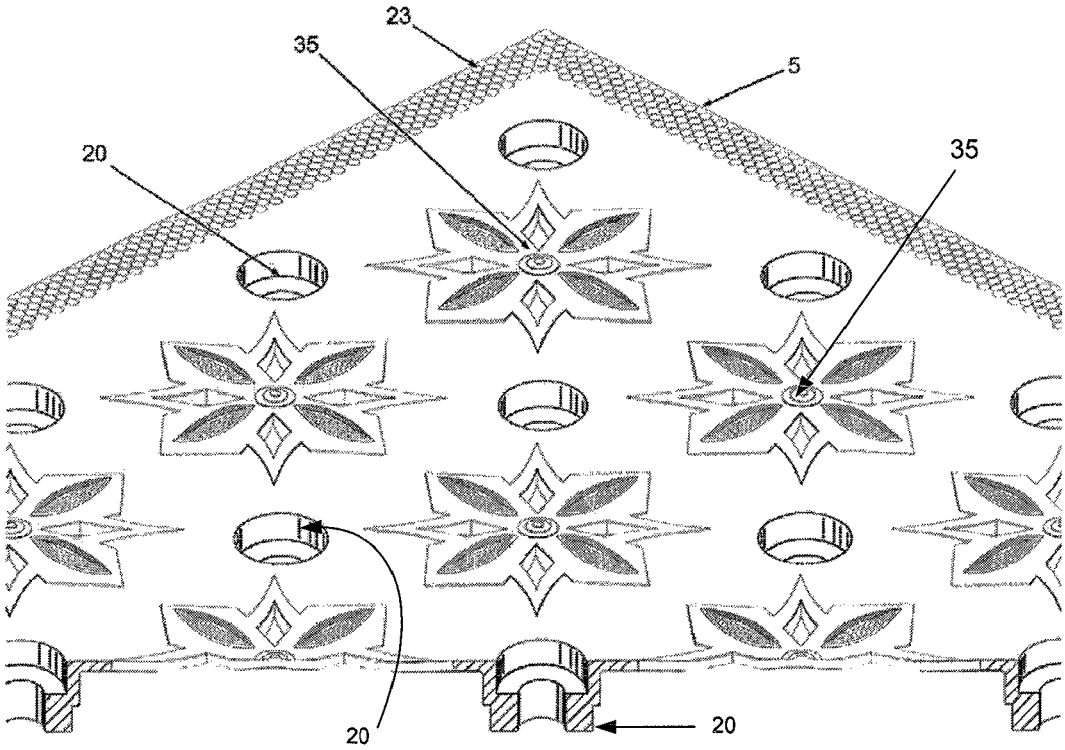
FIG. 3 illustrates a partial, top perspective view of a mat that may form a tarmac of the impact attenuation system of FIG. 2.
Figure 4:
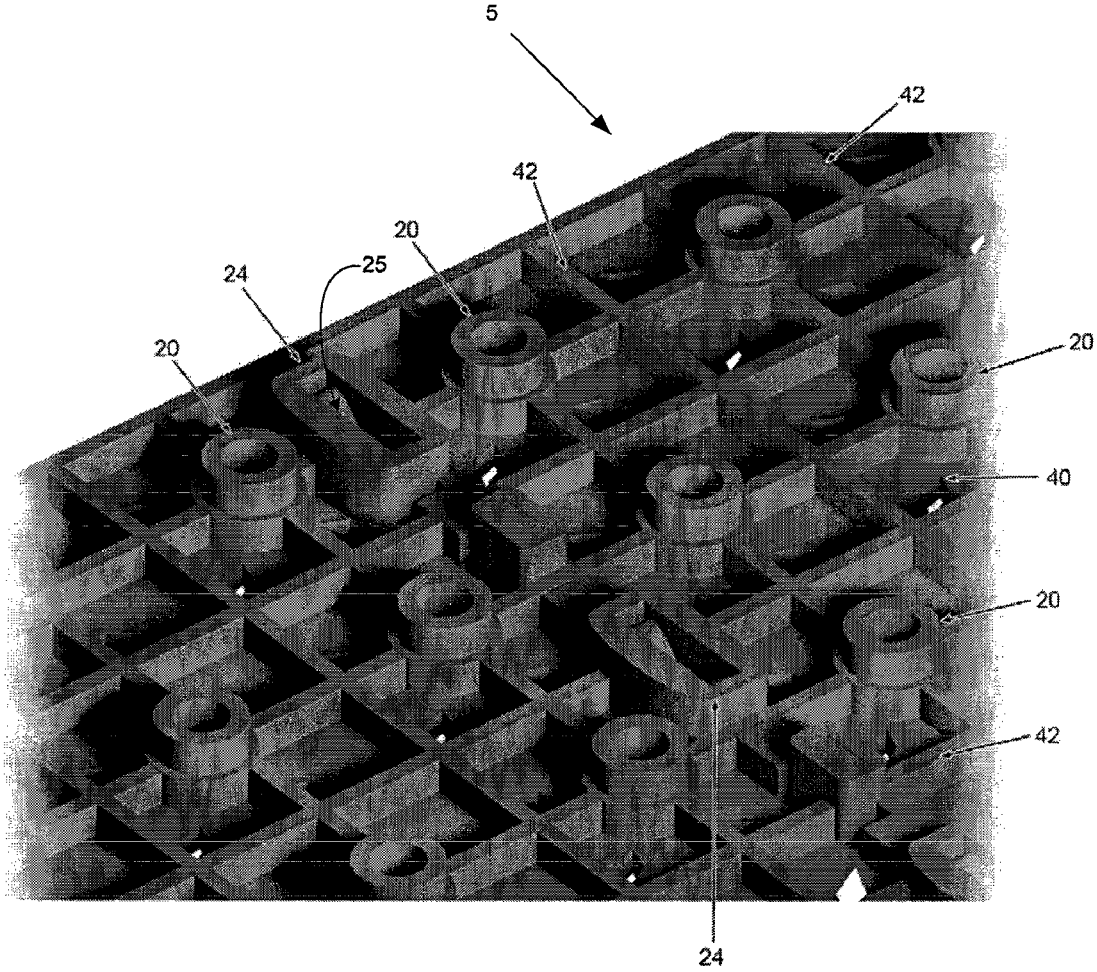
FIG. 4 illustrates a partial, bottom perspective view of two linked mats that may form the tarmac of the impact attenuation system FIG. 2.
Figure 5:
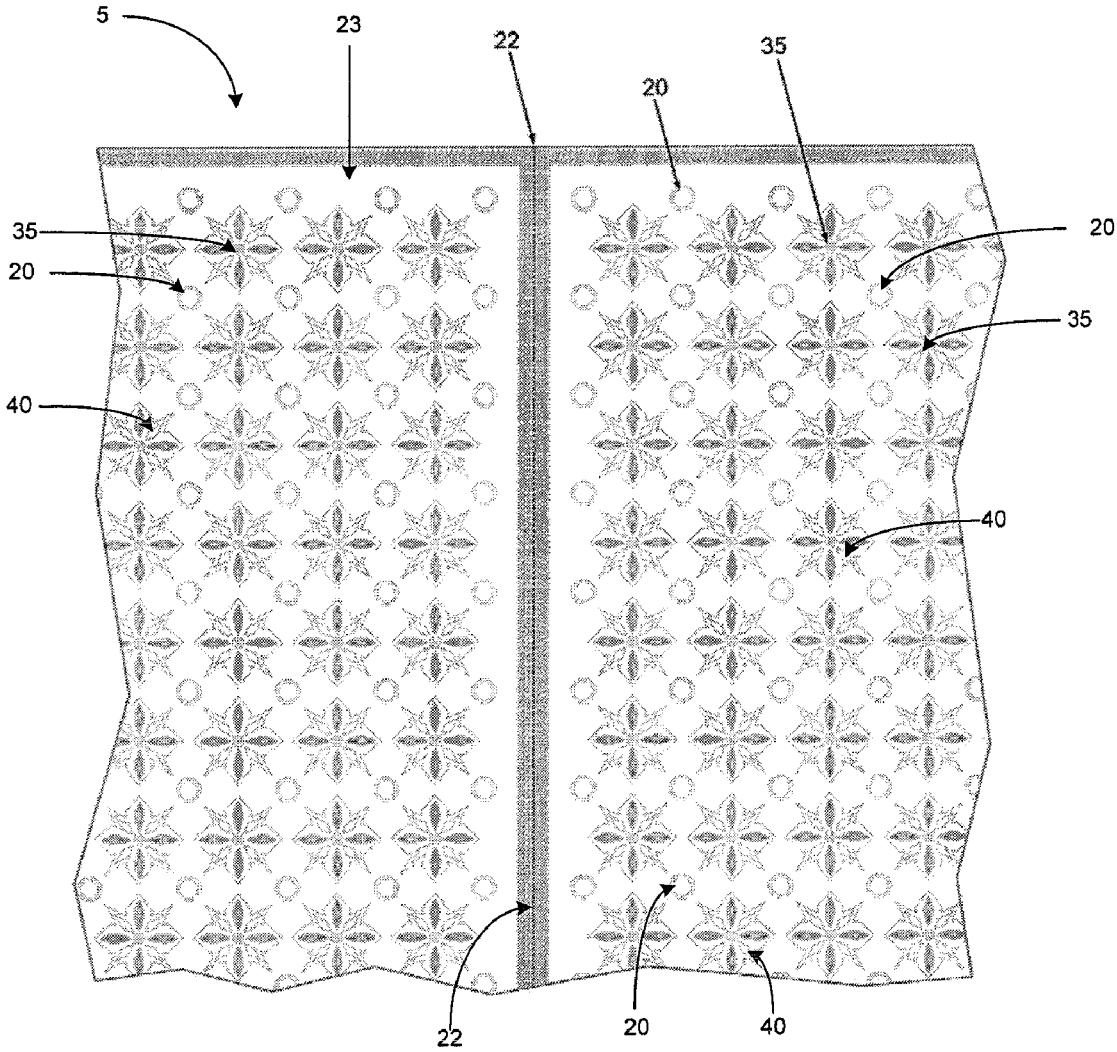
FIG. 5 illustrates a partial top view of two linked mats that may form the tarmac of the impact attenuation system FIG. 2.
Figure 6:
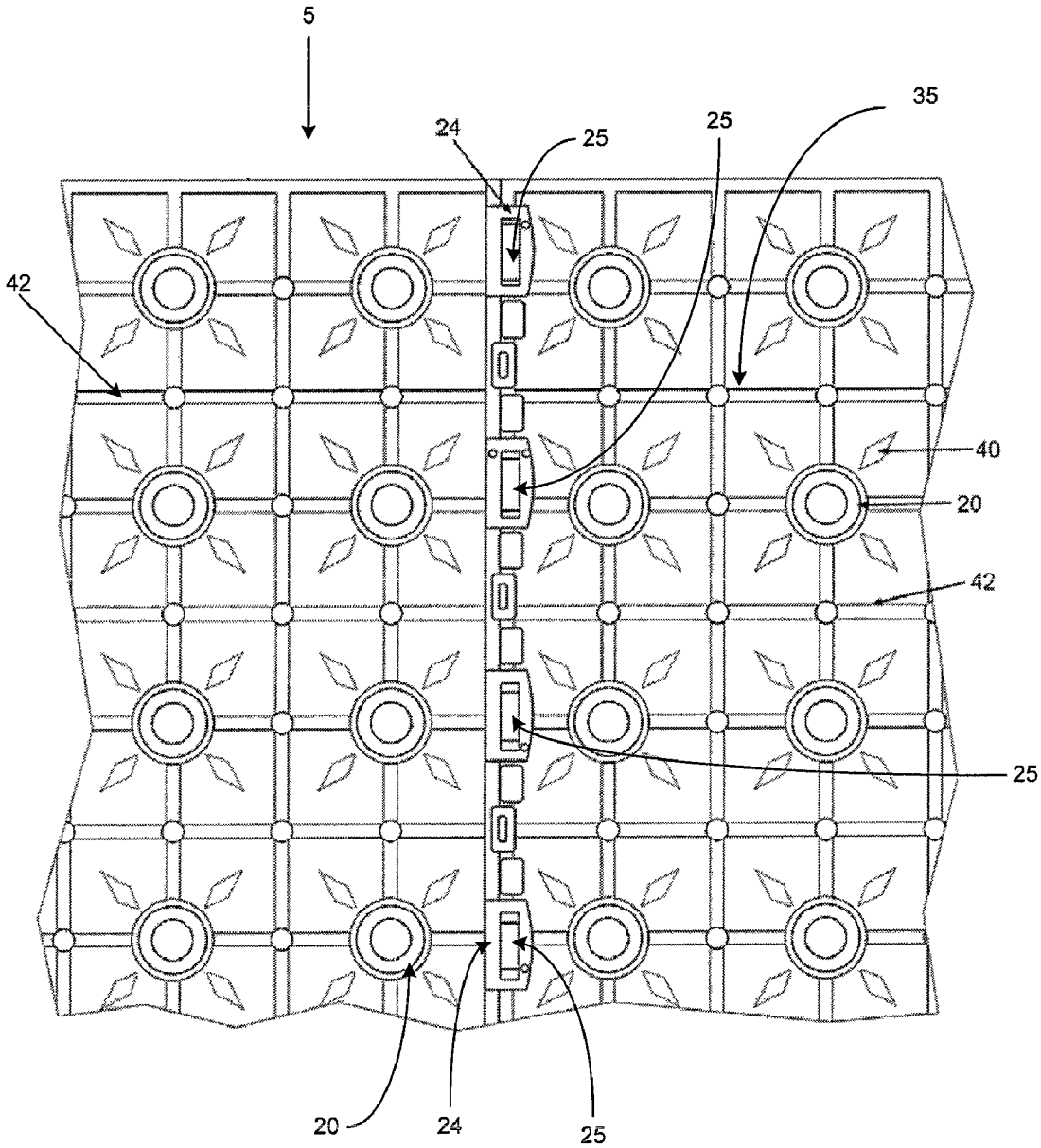
FIG. 6 illustrates a partial bottom view of two linked mats that may form the tarmac of the impact attenuation system FIG. 2.

FIGS. 3-6 illustrate an exemplary mat 5 or mats 5 that may be used to form the tarmac 15 covering over fill material 14. FIG. 3 illustrates a partial, top perspective view of a mat 5; FIG. 4 illustrates a partial, bottom perspective view of two interlocked mats, each like the mat shown in FIG. 3; and FIGS. 5 and 6 show top and bottom views, respectively, of two interlocked mats 5 each like the mat 5 shown in FIG. 3.

The exemplary mats 5 shown in FIGS. 3-6 comprise a relatively thin surface structure 23 supported by a grid structure comprising an array of legs 20 that are connected one with another by rib structures 42. As also shown, surface structure 23 includes a plurality of arches 35 each located generally between four legs 20 and four rib structures 42.

The exemplary embodiments teach at least three impact attenuation techniques which may be used either separately or in combination with each other. The mat 5 structure illustrated in FIGS. 3-6 absorbs the impact of a child's fall in several ways. First, arches 35 are flexible and absorb or attenuate at least some of the force from a child's fall. Second, the rib-grid structure (formed by legs 20 and rib structures 42) allows the mat 5 to flex horizontally with respect to the top surface of the mat 5. The rib-grid thus dissipates some of the force from the child's fall horizontally through mat 5. Third, the mat 5 transfers some of the energy from the child's fall through legs 20 to fill material 14, which as discussed above, itself is soft and readily absorbs at least part of the energy from the child's fall.

As a result, when a child falls onto the tarmac 15, three separate energy attenuating features aid in reducing the adverse effects of such a fall. First the impact causes the arches 35 to flex, absorbing energy. Second the entire tarmac 15 flexes horizontally dissipating some of the impact from the child's fall horizontally (e.g., generally level with ground 2). Third, the fill material 14 absorbs some of the force from the child's impact with the tarmac 15.

The amount of flex in the arches 35 depends on the radius of curvature in the arch, the height of the arch, as well as the material from which the mat 5 is made. The amount of flex provided by the grid structure depends on several factors, including the materials that form the legs 20 and rib structures 42, and the size, spacing, and number of legs 20 and the size and thickness of the rib structures 42.

The arches 35 of mats 5 form an undulating pattern on the outer surface of the tarmac 15, which may improve the tarmac 15's traction by allowing increased surface contact between a patron's foot or shoe and the tarmac 15. In addition, there are a number of pores 40 formed in a mat 5, which allow water to drain through mats 5. A seam 22 between two adjacent mats 5 also provides improved flex upon impact by spreading under a force, as well as the convenience of replacing the surface in a particular area for low cost and as needed.

Figure 9:
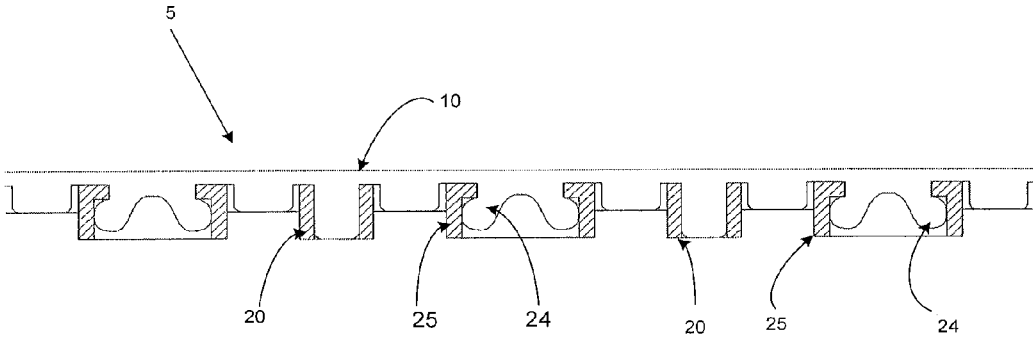
FIG. 9 illustrates an exemplary cut-away view of a mat having a plurality of tabs and slots fit together.

As best seen in FIG. 6, which shows the bottom side of two interlinked mats 5, linking tabs 24 couple adjacent mats 5 by sliding into slot 25 (see FIG. 9). Tab 24 is designed to provide a secure link and may also be designed to flex to absorb energy from an impact, such as a falling child. In addition to the linking tabs 24, the mats 5 are secured using both an adhesive such as glue and a heat source where two adjacent mats 5 are configured to overlap. In such a case the mats 5 are bonded together using both an adhesive and a heat source to melt the contacting plastic and further improve the bond. For example, the linking tab 24 may be coupled to an adjacent mat, a heat gun may be used to melt and fuse the tab to the adjacent surfaces, an adhesive such as a glue may then be used to bond the two adjacent mat surfaces. Of course the heat treatment can only be used on thermoplastics such as PVC.

The combination of an impact attenuation fill material 14 and an impact attenuation tarmac 15 overlaying the fill material 14, as shown in FIG. 2, has been found to provide greater impact attenuation than the sum of the impact attenuation of the fill material 14 by itself and the impact attenuation of the tarmac 15 by itself. That is, the impact attenuating system of FIG. 2 absorbs more energy from an impact—and thus provides greater protection to a failing child—than the sum of the energy absorbed by the fill material 14 alone and the tarmac 15 alone. This unexpected, synergistic increase in the impact attenuation properties of the combination of tarmac 15 overlaying fill material 14 is believed to be due to the multiple ways in which the system absorbs energy from an impact.

As discussed above, the impact attenuation system 12 of FIG. 2 attenuates an impact in three ways. First, referring to the mat 5 depicted in FIGS. 3-6, the arches 35 deform generally vertically with respect to the top surface of surface structure 10 (which is generally in the direction of the impact force) and thereby attenuate energy from an impact. Second, as discussed above, the grid structure comprising the array of legs 20 and interconnecting rib structures 42 allows mats 5 to flex generally horizontally with respect to the top surface of surface structure 10 and thereby attenuate energy from an impact. Third, as also discussed above, energy from the impact is transferred through legs 20 to fill material 14, which also attenuates energy from the impact. The energy from the impact is attenuated by the fill material 14 as individual pieces of fill material 14 move closer together and flex under the force of the impact.

The performance of the exemplary system can meet the gmax<200 and Head Impact Criterion<1000 requirements from a critical fall height of 13 feet.

In addition to absorbing energy from an impact (e.g., a falling child), the grid structure comprising the array of legs 20 and interconnecting rib structures provides mats 5 with a sufficiently firm surface to allow rolling equipment to be used on tarmac 15 Generally speaking, the less a wheel sinks into a surface, the less effort and energy is required to roll the wheel across the surface and to turn the wheel on the surface. As one example, the grid structure formed by legs 20 and interconnecting rib structures 42 may be configured to provide tarmac 15 with a sufficiently firm surface for a baby stroller to be pushed on the tarmac 15 surface and the wheels turned on the tarmac 15 surface by a typical adult without requiring an uncomfortable effort from the adult. As another example, the grid structure formed by legs 20 and interconnecting rib structures 42 may be configured to provide tarmac 15 with a sufficiently firm surface to meet ADA standards for use of a wheel chair on the surface of tarmac 15.

Thus, as discussed above, the tarmac 15 shown in FIG. 2 is able to meet both the impact attenuation requirements for protecting a child from a fall of the ASTM guidelines and the ADA requirements for wheelchair accessibility. That is, the combination of tarmac 15 and fill material 14, as shown in FIG. 2, is sufficiently impact absorbing to protect a child from a fall while at the same time provide a sufficiently firm surface to allow the use of a wheel chair on the tarmac 15.

Figure 7:
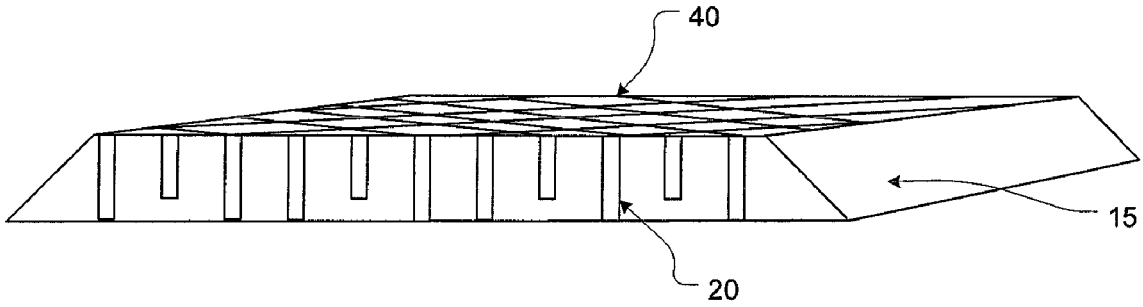
FIG. 7 illustrates an exemplary tarmac used under water according to some exemplary embodiments of the present invention.

Referring now to FIG. 7, there is illustrated an exemplary embodiment of the present invention, wherein a tarmac 15 having legs 20 is used in a wet environment. Thus, the pores 40 allow water to leave the surface of the tarmac 15 and drain to the ground below. As discussed above, legs 20 may have a variety of different lengths and thus increase the impact attenuating properties of the tarmac 15.

Figure 8:
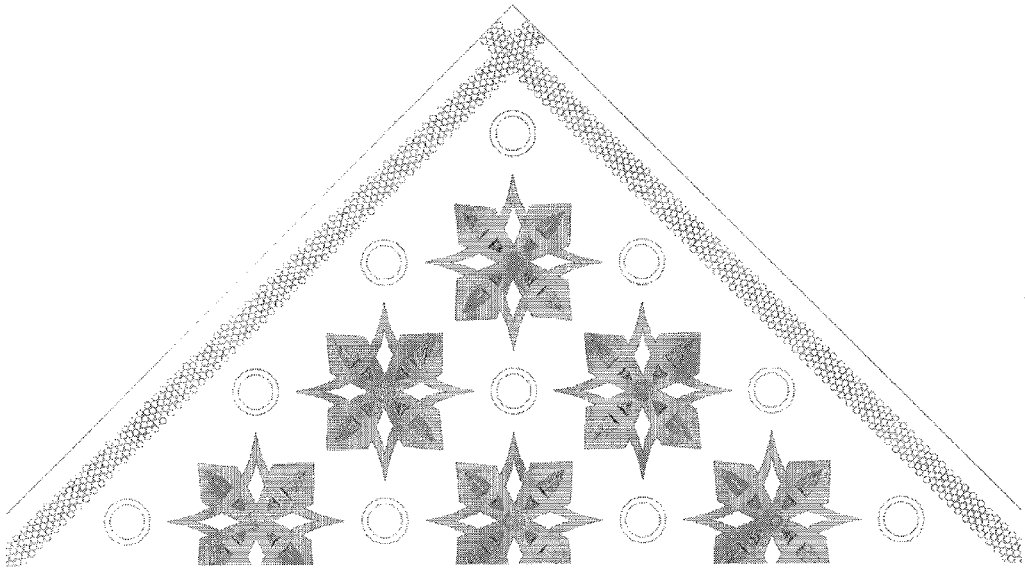
FIG. 8 illustrates an exemplary embodiment of an underwater mat.

The alternative exemplary embodiment of FIG. 8 may also include using the tarmac 15 underwater, such as at the bottom of a pool. Oftentimes pools made of concrete are very rough and may cause blisters. To cure this problem, pool owners often need to acid wash their pools which is not only expensive, but also requires the pool to be fully drained and then refilled. The present invention allows tarmac 15 to be placed in direct contact with the cement to provide a smoother surface for the bottom of the pool. In addition, the tarmac 15 increases the pool's safety by attenuating the impact of a diver hitting the bottom of a shallow end of the pool. Such protection is important because an impact with the concrete could result in a serious or fatal injury.

Finally FIG. 9 illustrates a exemplary embodiment of a cut-away view of the seam connecting two adjacent mats 5. In this exemplary embodiment a plurality of tabs 24 from a first mat 5 are fit into a plurality of receiving slots 25 to secure the two mats. Additionally glue and/or a thermal bond may be formed between the mats so as to further strengthen the couple holding the mats 5 together.

Although specific embodiments and applications of the invention have been described in this specification, there is no intention that the invention be limited these exemplary embodiments and applications or to the manner in which the exemplary embodiments and applications operate or are described herein.

What is claimed is:

1. An impact attenuation system comprising:

an impact attenuating mat having a top surface and a bottom surface, the mat being supported by a rib grid disposed on the bottom surface of the mat;

an impact attenuating loose-fill subsurface base upon which the impact attenuating mat is placed wherein said impact attenuating surface and attenuating loose-fill subsurface work in conjunction to form a system with a head injury criterion less than 1000 and a gmax less than 200; and a plurality of legs extending from the impact attenuating mat to the impact attenuating loose-fill subsurface.

2. The system of claim 1 wherein the impact attenuating mat further comprises a plurality of impact attenuating arches on the top surface.

3. The system of claim 1 wherein the legs are of a variety of heights.

4. The system of claim 1 wherein the impact attenuating mat further comprises a selectively coupleable and energy attenuating lock means positioned on an interior edge of the impact attenuating mat.

5. The system of claim 1 wherein the impact attenuating mat further comprising an exterior edge having a ramped edge.

6. The system of claim 1 wherein the legs sit on top of the loose-fill subsurface base.

7. The system of claim 1 wherein the legs extend into the loose-fill subsurface base.

8. The system of claim 1 wherein the impact attenuating mat is tethered to the ground.

9. The system of claim 1 wherein the impact attenuating mat further comprises a leg density of approximately 1 leg per 2 square inches.

10. The system of claim 1 wherein the impact attenuating mat includes a plurality of mats and wherein the plurality of mats are glued together.

11. The system of claim 1 wherein the impact attenuating mat includes a plurality of mats and wherein the plurality of mats are treated with heat to form a bond between the mats.

12. The system of claim 1 further comprising a fabric disposed between the loose-fill subsurface base and the plurality of legs.

13. The system of claim 1 wherein the impact attenuating loose-fill subsurface base includes at least one of sand, wood chips, gravel, and shredded tires.

* * * * *